US007798470B2

(12) United States Patent
McLoughlin et al.

(10) Patent No.: US 7,798,470 B2
(45) Date of Patent: Sep. 21, 2010

(54) RESCUE TOOL ADAPTERS AND METHODS OF USING SAME

(75) Inventors: John E. McLoughlin, Lake Grove, NY (US); Neocles G. Athanasiades, Setauket, NY (US); Toh M. Meng, Hauppauge, NY (US)

(73) Assignee: JNT Link, LLC, Nesconset, NY (US)

( * ) Notice: Subject to any disclaimer, the term of this patent is extended or adjusted under 35 U.S.C. 154(b) by 1059 days.

(21) Appl. No.: 11/075,215

(22) Filed: Mar. 9, 2005

(65) Prior Publication Data

US 2006/0202180 A1 Sep. 14, 2006

(51) Int. Cl.
*B66F 3/00* (2006.01)

(52) U.S. Cl. ..... 254/133 R; 29/267

(58) Field of Classification Search ..... 72/392, 72/705; 254/93 R, 133 R, 134, 17, 131, 133 A; 29/267; 294/19.1, 26
See application file for complete search history.

(56) References Cited

U.S. PATENT DOCUMENTS

| | | | | |
|---|---|---|---|---|
| 2,681,791 | A * | 6/1954 | Hahn | 254/131 |
| 4,165,114 | A * | 8/1979 | Nutter | 294/19.1 |
| 5,215,288 | A * | 6/1993 | Lyon | 254/133 A |
| 5,232,204 | A * | 8/1993 | Nunez | 254/133 A |
| 5,769,394 | A * | 6/1998 | Yirmiyahu et al. | 254/93 R |
| 6,272,900 | B1 * | 8/2001 | Kobel | 72/392 |

* cited by examiner

*Primary Examiner*—Lee D Wilson
(74) *Attorney, Agent, or Firm*—Haynes and Boone, LLP

(57) ABSTRACT

Adapters and methods are provided for utilization on a powered two armed rescue tool for opening metal doors. The adapter has a first end portion of general "U" configuration which is hooked over a door. The adapter is connected to one arm of the powered rescue tool and the other arm is positioned in contact with the frame of the door. The powered rescue tool is then actuated which causes the arms to separate and force the door open.

7 Claims, 1 Drawing Sheet

RESCUE TOOL ADAPTERS AND METHODS OF USING SAME

CROSS REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The subject invention relates to adapters for two armed powered rescue tools and the methods of using them.

More specifically, the subject invention relates to adapters of two different constructions for connection to one arm of a powered rescue tool and the methods of using the adapters with the powered rescue tool to open a metal door.

2. Description of Related Art including Information Disclosed under 37 CFR 1.97 and 1.98

Two-armed powered rescue tools are well known in the art. They are sometimes referred to as "The Jaws of Life" and by other names. They have various attachments or adapters that are connectable to one of the arms of the tool. A typical two-armed rescue tool is disclosed in U.S. Pat. No. 3,819,153, herein incorporated by reference. The rescue tools are helpful in prying, cutting and squeezing metal in order to gain access to the interior, for example the interior of a vehicle.

The subject adapter is specifically constructed for use with the powered rescue tools and have been found to be highly efficient for use in prying open a metal door.

BRIEF SUMMARY OF THE INVENTION

In one aspect of the invention, a rescue tool adapter is provided for a powered two armed rescue tool utilized for opening metal doors. The adapter has first and second end portions. The first end portion is of general "U" configuration and has first and second legs. The first and second legs are spaced apart a distance greater than the thickness of a door to be opened. The second end portion is connectable to one of the arms of a rescue tool at one end and is connected to the adapter second end portion at the other end.

In another aspect of the invention, a method of using the adapter is described. In this method of using, the adapter set forth immediately above is selected and installed on one leg of the powered rescue tool. The first end portion of the adapter is then hooked over the door and the second rescue tool arm is placed in contact with the door frame at a location spaced from said door. The powered rescue tool is then actuated.

BRIEF DESCRIPTION OF THE SEVERAL VIEWS OF THE DRAWING(S)

DETAILED DESCRIPTION OF THE INVENTION

Figure 1:
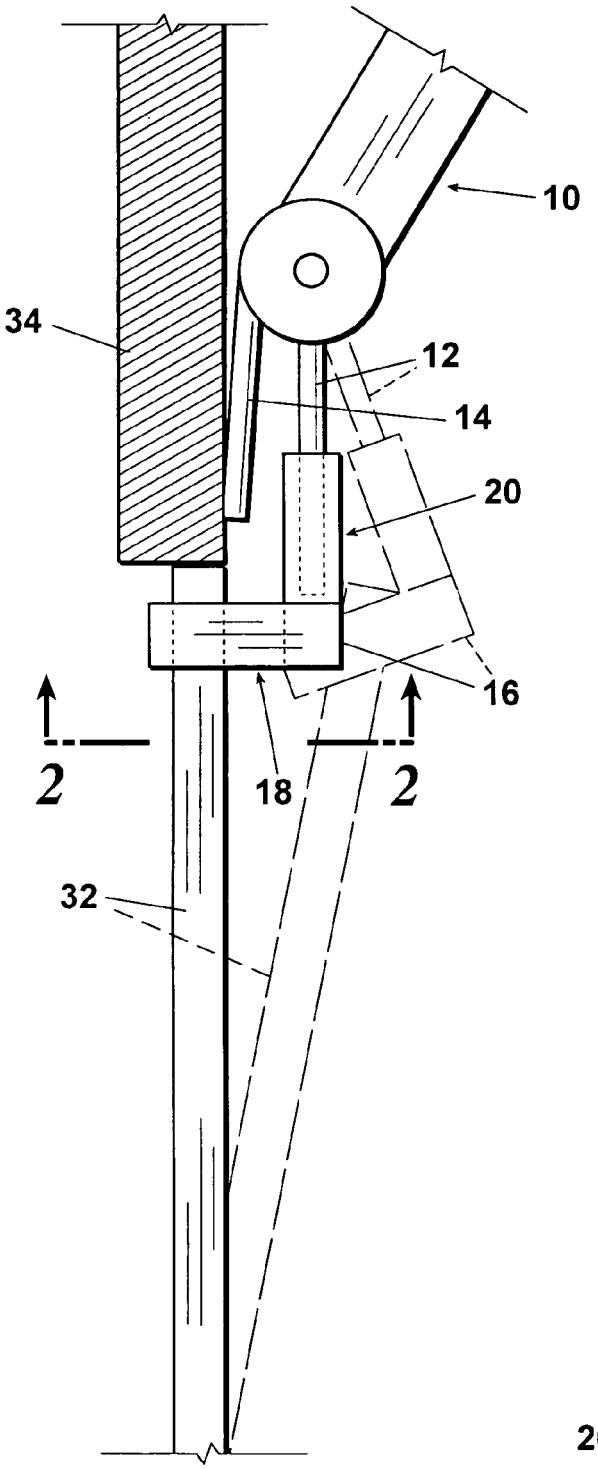
FIG. 1 is a partial top view of a powered two armed rescue tool with the adapter of this invention installed thereon.

Referring to FIG. 1, a powered rescue tool 10, as well known in the art, has first and second arms 12,14. Upon actuation of the rescue tool 10, one of the arms pivotally moves outwardly and away from the other arm. The adapter 16 of this invention is here shown installed on the first arm 12 of the rescue tool 10.

Figure 2:
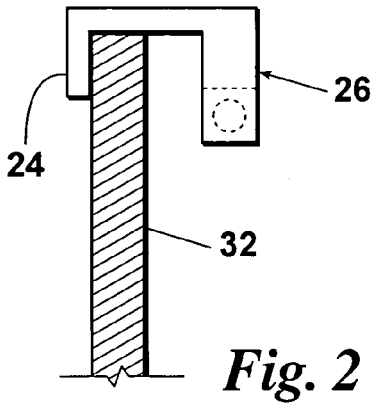
FIG. 2 is a frontal view of a portion of the adapter in position over a door.
Figure 3:
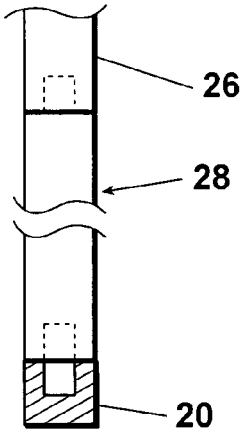
FIG. 3 is a partial view of the second leg of the first end portion and an extension of the adapter of this invention.
Figure 4:
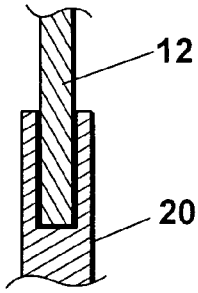
FIG. 4 is a partial sectional view of a connection of the adapter to the rescue tool arm.

Referring to FIGS. 1-3, the adapter 16 has first and second end portions 18,20. The first end portion 18 is of a general "U" configuration having first and second legs 24,26, as shown in FIG. 2. As can be seen, in the preferred embodiment, the second leg 26 is of greater length than the first leg 24.

By providing the apparatus of this invention with a second leg 26 of longer and varying dimensions, an operator can position the second arm 14 of the powered rescue tool at the most advantageous location for exerting force on the door. This is an important aspect of the adapter in that, as is known, in vehicle accidents, doors and door frames become quite distorted resulting in varying positions at which the door can be most conveniently and efficiently opened.

Referring to FIG. 3, a second leg extension 28 is shown. The second leg extension 28 can be formed with various lengths. One end of the second leg extension 28 is connectable to the second leg 26 and the other end is connected to the second end portion 20 of the adapter 16. It should be understood that adapters 16 can be formed with the second leg 26 being of unitary construction while providing a plurality of second leg lengths for having greater flexibility.

The first and second legs 24,26 are spaced apart a distance greater than the thickness of a door to be opened. The second end portion 20 of the adapter 16 is of a construction to be connectable at one end to one of the arms 12 of the powered rescue tool 10 and connected at the other end to the first end 18 portion of the adapter.

Figure 5:
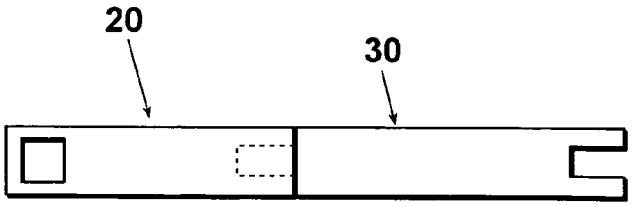
FIG. 5 is a partial sectional view of another embodiment of the adapter having a body extension.

For reasons as describe above with reference to FIG. 3, the second end portion of the adapter can also be advantageously provided with a body extension 30, as shown in FIG. 5. The body extension 30 is connectable at one end to the first end portion 18 of the adapter 16 and is connectable at the other end to the first arm 12 of the power rescue tool.

In the method of opening a door 32 with a powered rescue tool 10 comprises selecting one of the rescue tool adapters 16 as set forth above, assembling and installing the rescue tool adapter 16 on one arm 12 of the powered rescue tool 10. The first end portion for the adapter 16 is hooked over the door 32 and the second arm 14 is positioned in contact with the door frame 34 at a location spaced from the door 32. The powered rescue tool 10 is then actuated.

Other aspects, objects and advantages will become apparent from a study of the drawings, the specification and appended claims.

The invention claimed is:

1. A rescue tool adapter for a powered two-armed rescue tool utilized for opening metal doors, comprising:

said adapter having first and second end portions;

said first end portion being of general U-shaped configuration lying generally in a plane, and having first and second legs, said first leg having a length, and said second leg having a length;

said first and second legs being spaced apart a distance greater than the thickness of a door to be opened;

said second end portion being connectable to an arm of the rescue tool at one end and being connectable to the adapter first end portion at the other end and being substantially perpendicular to said plane; and said adapter being further designed to transmit a pulling force in a lateral direction, away from a door frame, thereby forcing the door to open in a lateral direction, away from the door frame.

2. A rescue tool adapter, as set forth in claim 1, wherein the length of the second leg is longer than the length of the first leg.

3. A rescue tool adapter, as set forth in claim 1, including a leg extension being connectable between the first end portion and the second end portion, said leg extension being connectable at a first end to the second leg of the first end portion of the adapter and at a second end to the second end portion of the adapter.

4. A rescue tool adapter for mounting on a powered two-armed rescue tool utilized for force-opening a door, comprising:

a first end portion, the first end portion comprising:

a first leg having a first length, said first leg further having a first end and a second end, said first leg further having an inside surface whereby the first leg inside surface can be used to apply force to an inside portion of a door, the first leg inside surface being orientable generally perpendicular towards a lateral direction, away from a door frame;

a second leg having a second length, said second leg having a first end and a second end, said second leg being substantially parallel to said first leg, said second leg further having an inside surface being generally oriented in a direction facing the first leg inside surface;

a third portion having a third length, a first end and a second end, the third portion being usable to span a thickness of the door, the third length being generally longer than the thickness of the door at which the adapter may be operatively positioned, the third portion being orientable generally in alignment with said lateral direction, away from the door frame, said third portion forming a U-shaped configuration with the first leg and the second leg, wherein the first leg second end is coupled to the third portion first end at a substantially perpendicular angle, wherein the second leg second end is coupled to the third portion second end at a substantially perpendicular angle, said first leg, second leg and third portion all lying generally in a first plane, said first leg having said first leg first end pointing generally away from the third portion and said second leg having said second leg first end pointing generally in the same direction as the first leg first end;

said adapter being connectable at the second leg first end to a first arm of the rescue tool at a substantially perpendicular angle, with said rescue tool first arm lying in a second plane generally perpendicular to said first plane, the rescue tool having a second arm operable to be braced against the door frame, said adapter being designed to transmit a pulling force in the lateral direction, away from the door frame, from the first arm of the rescue tool through the second leg, then through the third portion, then through the first leg to the inside portion of the door, thereby forcing the door to open in a lateral direction, away from the door frame.

5. The rescue tool adapter of claim 4, for mounting on a powered two-armed rescue tool utilized for force-opening a door by applying a pulling force in the lateral direction, further comprising a second end portion having a first end and a second end, wherein said second end portion first end is connectable to the second leg first end, said second end portion being oriented substantially perpendicular to the second leg and lying generally in the second plane in general alignment with the first arm of the rescue tool, and wherein the second end portion second end is connectable to the first arm of the rescue tool, wherein said second end portion elongates a distance between the first end portion of the adapter and the rescue tool.

6. The rescue tool adapter of claim 4, for mounting on a powered two-armed rescue tool utilized for force-opening a door by applying a pulling force in the lateral direction, which is away from the door frame, wherein the second length of the second leg is longer than the first length of the first leg.

7. The rescue tool adapter of claim 4, for mounting on a powered two-armed rescue tool utilized for force-opening a door by applying a pulling force in the lateral direction, which is away from the door frame, further comprising a second leg extension portion having a first end and a second end, wherein said second leg extension portion first end is connected to the second leg first end, said second leg extension portion being oriented generally in alignment with the second leg and lying generally in the first plane, and wherein the second leg extension portion second end is connectable to the first arm of the rescue tool at a substantially perpendicular angle, with said rescue tool first arm lying in a third plane perpendicular to said first plane and parallel to said second plane, wherein said second leg extension portion elongates a second distance between the second leg of the adapter and the powered two-armed rescue tool.

* * * * *